United States Patent [19]

Gugel et al.

[11] Patent Number: 5,073,051

[45] Date of Patent: Dec. 17, 1991

[54] MATRIX PIN PRINT HEAD HAVING A SHIELD TO COUNTER MAGNETIC FIELDS

[75] Inventors: Bernd Gugel, Ulm-Einsingen; Matthias Ullrich, Albeck, both of Fed. Rep. of Germany

[73] Assignee: Mannesmann Aktiengesellschaft, Düsseldorf, Fed. Rep. of Germany

[21] Appl. No.: 481,166

[22] Filed: Feb. 20, 1990

[30] Foreign Application Priority Data

Feb. 20, 1989 [EP] European Pat. Off. ..... 89730039.8

[51] Int. Cl.[5] ..... B41J 2/27

[52] U.S. Cl. ..... 400/124; 101/93.05

[58] Field of Search ..... 400/124; 101/93.04–93.05

[56] References Cited

U.S. PATENT DOCUMENTS

| | | | |
|---|---|---|---|
| 4,258,623 | 3/1981 | Barrus et al. | 101/93.04 |
| 4,527,469 | 7/1985 | Wolf et al. | 101/93.04 |
| 4,568,207 | 2/1986 | Hara et al. | 400/124 |
| 4,597,680 | 7/1986 | Norigoe et al. | 400/124 |
| 4,820,065 | 4/1989 | Koyama et al. | 400/124 |
| 4,895,463 | 1/1990 | Wysk | 400/124 |
| 4,895,464 | 1/1990 | Rubinshtein | 400/124 |
| 4,976,554 | 12/1990 | Shimosato et al. | 400/124 |

FOREIGN PATENT DOCUMENTS

| | | | |
|---|---|---|---|
| 0141569 | 6/1986 | Japan . | |
| 0264238 | 6/1986 | Japan . | |
| 0259871 | 11/1987 | Japan | 400/124 |
| 2164001 | 3/1986 | United Kingdom | 400/124 |

*Primary Examiner*—David A. Wiecking
*Assistant Examiner*—John S. Hilten
*Attorney, Agent, or Firm*—Horst M. Kasper

[57] ABSTRACT

A matrix pin print head, particularly of the biased construction, includes a base plate (1) made of a soft-magnetic material, an annular permanent magnet (2), a distance spacer ring (3), a spring (4) tensioned in each case radially outwardly, where an armature body (6) is attached at the spring (4), which armature body (6) can be biased in each case against the core (7) of an electromagnetic coil (8) disposed in each case on the base plate (1), wherein the magnet flux generated by the permanent magnet (2) can be balanced by feeding a current through the electromagnetic coil (8), and wherein the armature body (6), at which armature body (6) there is attached a print element (4*a*), can be shot off against a recording material carrier, and wherein there is possibly provided a side magnet flux circuit via a short circuit body in addition to the main magnet flux circuit (9) formed via the permanent magnet (2). In order to avoid a power-reducing interaction of neighboring electromagnetic coils based on their magnet fields, each electromagnetic coil (8) is surrounded at its circumference (8*a*) in part or fully with soft-magnetic materials (11).

28 Claims, 2 Drawing Sheets

MATRIX PIN PRINT HEAD HAVING A SHIELD TO COUNTER MAGNETIC FIELDS

BACKGROUND OF THE INVENTION

1. Field of the Invention

The invention relates to a matrix pin print head of the biased construction with a base plate made of a soft-magnetic material, an annular permanent magnet disposed on the base plate, a distance spacer ring made of a soft-magnetic material, a spring which, in each case, is tensioned and clamped radially outwardly, where, in each case, an armature body is attached radially inwardly at said spring, which armature body, in each case, can be biased against the core of an electromagnetic coil, disposed in each case on the base plate.

2. Brief Description of the Background of the Invention Including Prior Art

Such a matrix pin print head is in general equipped with a permanent magnet in contrast to the matrix pin print head of the hinged clapper armature type. A first main magnet flux circuit is effected and composed via the core of an electromagnetic coil, via the armature body or, respectively, the armature, the distance spacer ring, the permanent magnet, the base plate and returned back.

It has been proposed in the German Patent Application Laid Open DE 3,110,798 to create a parallel resistor, which is formed by a short-circuit body, as a side magnet flux circuit for optimizing the main magnet flux circuit. The side magnet flux circuit reduces the main magnet flux circuit to an intensity such that a low current passage (ampere winding number) of the electromagnetic coil is sufficient to completely balance the magnetic field of the permanent magnet, i.e. to shoot off the armature body attached to the spring, at which armature body the print element is attached, such that the print element generates a dot on the paper.

The so-called optimization of the field line guide allows to reduce the product, resulting from current intensity times number of turns, such that a construction can be produced either with a lower current intensity or with a smaller number of turns of the copper wire, or with a somewhat less reduced current intensity and a somewhat less reduced number of turns. In this case, a reduced current intensity is associated with a situation of a reduced waste heat dissipation.

This optimization of the holding power of the permanent magnet can now be set, according to the conventional teaching, by a magnetic property of the side flux circuit (shunt ring) such that the magnetic resistance of the set-up yoke increases with increasing temperature of the set-up yoke forming the side magnet ring.

Another conventional teaching of the German Patent DE-PS 3,644,185, which is also concerned with the optimization of the holding power, resolves the optimization problem in that the thickness of the side magnet ring (shunt ring) is variable depending on the main-series magnet circuit with the permanent magnet and, for tuning to the working or operating point, a side magnet shunt ring with a corresponding thickness is employed.

Based on experience of long standing and based on experiments, it has however been determined that the capabilities of a biased system permanent magnet/electromagnet does not only depend on the optimization of the holding power of the permanent magnet, but also on the simultaneous current passage through two neighboring or several electromagnetic coils. In particular, a possible simultaneous printing of two print dots in a character, such as, for example, in a letter "E", "F" and others, results in a mutual flux penetration of several electromagnetic fields, where neighboring magnetic fields act in opposed directions and result in a substantially deteriorated lifting or, respectively, displacement of the magnetic field. It has been found, that the print speed is decreased by an amount of about 30% based on this mutual influencing of the magnetic field.

SUMMARY OF THE INVENTION

1. Purposes of the Invention

It is an object of the present invention to optimize the holding power of the permanent magnet in addition to avoiding the power-decreasing influence of two neighboring electromagnetic coils of the permanent magnet-/electromagnet system.

It is yet another object of the present invention to provide that the magnet pins of a dot matrix print head can be operated individually without influence from other occurring action and from other magnetic alternating fields.

It is yet a further object of the present invention to reduce the magnetic interaction influence generated by an actuation of a print pin in a matrix print head relative to the surrounding environment.

These and other objects and advantages of the present invention will become evident from the description which follows.

2. Brief Description of the Invention

The present invention provides for a matrix pin print head including a recording material carrier and a base plate made of a soft-magnetic material. An annular permanent magnet is disposed on the base plate. A distance spacer ring is made of a soft-magnetic material. A pretensioned spring is furnished in each case at a radially outwardly disposed point. An electromagnetic coil is disposed in each case on the base plate. Each electromagnetic coil is surrounded at its circumference with a soft-magnetic material configuration and is thereby shielded against a magnetic field of neighboring electromagnetic coils. An armature body at a radially inwardly disposed point is attached in each case at the respective spring. The armature body, in each case, is biased against the core of the electromagnetic coil disposed in each case on the base plate. The magnetic flux, generated by the annular permanent magnet, is to be balanced by feeding current into the electromagnetic coil. The armature body can be shot off against the recording material carrier. A print element is attached at the armature body.

Each electromagnetic coil can be surrounded in part or fully at its circumference in part with soft-magnetic materials.

A side magnet shunt flux circuit can be formed via a short circuit body disposed above the main magnet flux circuit formed over the annular permanent magnet.

The print head can be formed based on the biased construction configuration.

The electromagnetic coil can be partially shielded. A separating wall, made of a soft-magnetic material, can be disposed between two electromagnetic coils, respectively.

A ring made of a soft-magnetic material can surround at least one of the electromagnetic coils.

The soft magnetic material configuration can be formed of a flowable mass made of a magnetically non-conductive material incorporating soft-magnetic particles, which mass can be cast around all electromagnetic coils.

A core ring can be disposed concentrically relative to the print head center axis. Electromagnetic coils, disposed diametrically opposite to each other, can be shielded by way of the core ring. A core ring can be disposed in elliptical shape relative to the print head center axis. Electromagnetic coils, disposed diametrically opposite to each other, can be shielded by way of the core ring.

Core-ring segments can be disposed concentrically or in elliptical shape relative to the print head center axis. Electromagnetic coils, disposed diametrically opposite to each other, can be shielded by way of core-ring segments.

An attachment plate can be disposed between the distance ring made of soft magnetic material and the spring. The thickness of the attachment plate can be from about 0.5 to 2 times the thickness of the annular permanent magnet. The thickness of the spacer ring can be from about 0.5 to 2 times the thickness of the annular permanent magnet.

A method for shielding electromagnetic coils in a matrix pin print head comprises the following steps. A recording material carrier, a base plate made of a soft-magnetic material, an annular permanent magnet disposed on the base plate, a distance spacer ring made of a soft-magnetic material, an in each case at a radially outwardly disposed point pretensioned spring and an electromagnetic coil disposed in each case on the base plate are assembled. Each electromagnetic coil is surrounded at its circumference with a soft-magnetic material configuration, thereby shielding the electromagnetic coil. A magnetic field is generated at a neighboring electromagnetic coil and the magnet field of the neighboring electromagnetic coil is diverted away from the electromagnetic coil with the soft magnetic material configuration. An armature body is biased at a radially inwardly disposed point attached in each case at the respective spring against the core of the electromagnetic coil disposed in each case on the base plate. Current is fed into the electromagnetic coil for balancing a magnet flux, generated by the annular permanent magnet. The armature body with a print element attached at the armature body is shot off against the recording material carrier.

According to the invention, each electromagnetic coil is surrounded at its circumference in part or fully by way of soft-magnetic materials and is thus shielded against the magnetic fields of neighboring electromagnetic coils. The soft-magnetic materials act as resistors for neighboring electromagnetic fields or as collectors for the field lines of neighboring magnetic fields such that the conventional field weakening can be substantially eliminated and that thus the power decrease does no longer occur or, respectively, a capacity increase for the throughput can be achieved by the recited amount of about 30%.

The practical application of the invention disclosure is further enhanced in that, in case of a partial shielding of an electromagnetic coil, there is disposed a separating wall made of soft-magnetic materials between, in each case, two electromagnetic coils. Such a separating wall can, for example, be easily produced together with the base plate as a single-piece sintered material part.

A complete shielding is achieved in that at least one of the neighboring electromagnetic coils is surrounded by a ring made of a soft-magnetic material.

According to a further feature of the invention, a flowable mass of magnetic non-conductive material, into which the soft-magnetic particles are introduced, is cast or poured around all electromagnetic coils. This mass, only flowable at the time of casting or pouring, hardens increasingly and acts as a completely surrounding sheathing by means of the recited rings.

According to a further feature, another possibility to eliminate the mutual influencing of the magnetic fields comprises that the additionally applicable improvement is used where diametrically oppositely disposed electromagnetic coils are shielded relative to each other by way of a core ring or by way of core-ring segments, which are disposed concentrically or in elliptical shape relative to the center axis of the print head.

The magnet flux generated by the permanent magnet by feeding current into the electromagnetic coil can be balanced or can be displaced. A print element, attached at the armature body can be shot off against a recording material carrier. In addition to the main magnet flux circuit formed via the permanent magnet, there can be formed a side magnet flux circuit via a short-circuit magnet body.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
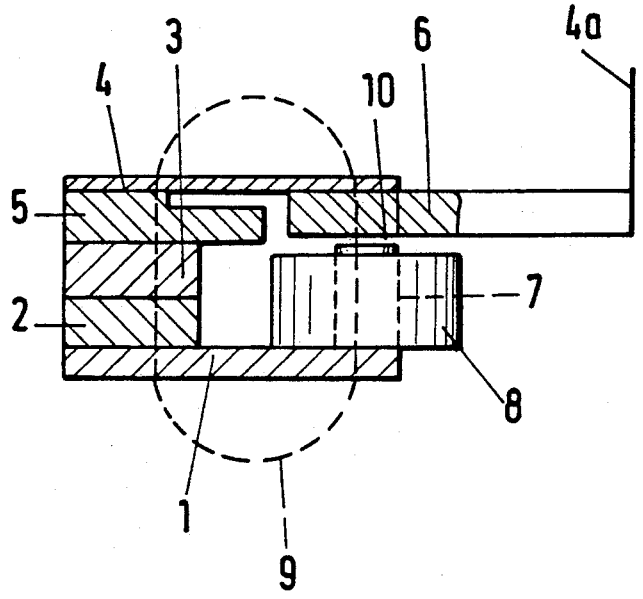
FIG. 1 is a half-side cross-section through the matrix pin print head of the biased construction.

In accordance with the present invention, there is provided a matrix pin print head, particularly of the biased construction. The matrix pin print head includes a base plate made of a soft-magnetic material, an annular permanent magnet disposed on the base plate, a distance spacer ring made of a soft-magnetic material, an in each case at a radially outwardly disposed point pretensioned spring. An armature body at a radially inwardly disposed point is attached in each case at the spring. The armature body in each case is biased against the core of an electromagnetic coil disposed in each case on the base plate. The magnet flux, generated by the permanent magnet, can be balanced by feeding current into the electromagnetic coil. The armature body can be shot off against a recording material carrier. A print element is attached at the armature body. Possibly a side magnet shunt flux circuit is formed via a short circuit body above the main magnet flux circuit formed over the permanent magnet. Each electromagnetic coil 8 is surrounded at its circumference 8*a* in part or fully with soft-magnetic materials 11 and is thereby shielded against the magnet field of neighboring electromagnetic coils 8.

In case of a partial shielding of an electromagnetic coil 8, there can be disposed a separating wall 12, made of a soft-magnetic material 11, between in each case two electromagnetic coils 8.

At least one of the neighboring electromagnetic coils 8 can be surrounded by a ring 13 made of a soft-magnetic material 11.

A flowable mass 14 made of a magnetically non-conductive material and incorporating soft-magnetic particles can be cast around all electromagnetic coils 8.

Electromagnetic coils 8, disposed diametrically opposite to each other, can be shielded by way of a core ring or by way of core-ring segments 15, which can be disposed concentrically or in elliptical shape relative to the print head center axis 16.

A matrix pin print head of the biased construction includes a base plate 1 made of a soft-magnetic material, an annular permanent magnet 2, and a distance spacer ring 3, made of a soft-magnetic material. Said print head further includes one, in each case, radially outwardly tensioned spring 4 for each print element 4*a*, an attachment plate 5, and an armature body 6 attached to the spring 4. Said armature body 6 is attracted in each case toward a core 7 of an electromagnetic coil 8 by way of the permanent magnet 2. Upon feeding in of current into the electromagnetic coil 8, the main magnet flux circuit 9 is balanced. The feeding of current into the electromagnetic coil 8 thus balances and lifts the power of the permanent magnet 2 and the bias energy stored in the spring 4 is released for the shooting off of the print element 4*a*. In this case, an air gap 10 is temporarily generated between the core 7 and the armature body 6.

A side flux shunt magnetic circuit is not illustrated because such a side flux shunt magnetic circuit is deemed unnecessary for the understanding of the invention.

Figure 2:
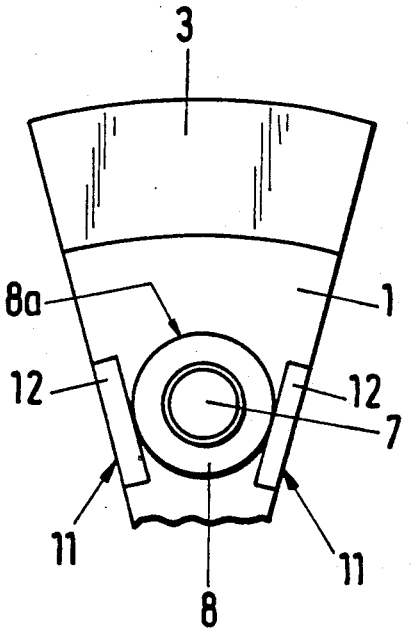
FIG. 2 is a top plan view onto the embodiment of FIG. 1, turned by 90 degrees, with armature removed.

The shielding of the electromagnetic coils 8 relative to each other occurs, according to a first embodiment illustrated in FIGS. 1 and 2, in that each electromagnetic coil 8 is surrounded at its circumference 8*a* by way of soft-magnetic materials 11, such as, for example, soft iron, steel with low carbon content, or an amorphous ferromagnetic metal alloy. This can be realized, as illustrated, by disposing separating walls 12 on two sides of the electromagnetic coil 8. The separating walls 12 can for example be made of soft iron.

Figure 3:
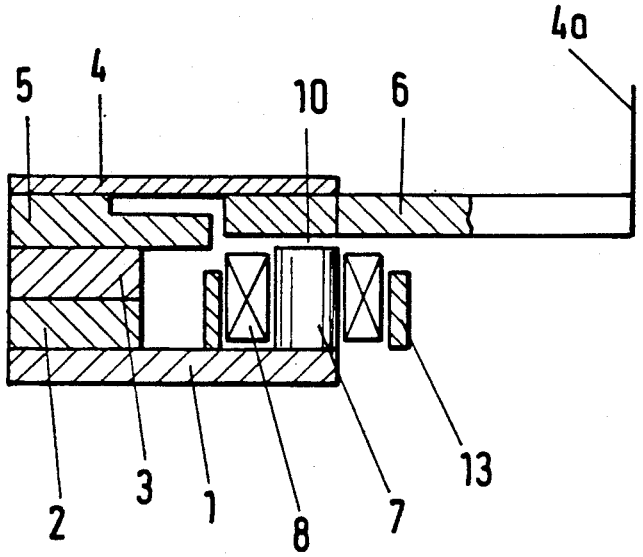
FIG. 3 is a half-side cross-section according to FIG. 1 for a second embodiment.
Figure 4:
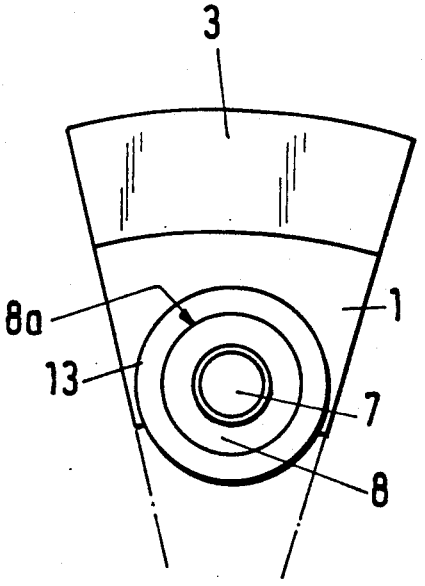
FIG. 4 is a top plan view onto the embodiment of FIG. 3, with armature removed.

According to a second embodiment illustrated in FIGS. 3 and 4, an electromagnetic coil 8 is surrounded by a ring 13 made of a soft-magnetic material.

Figure 5:
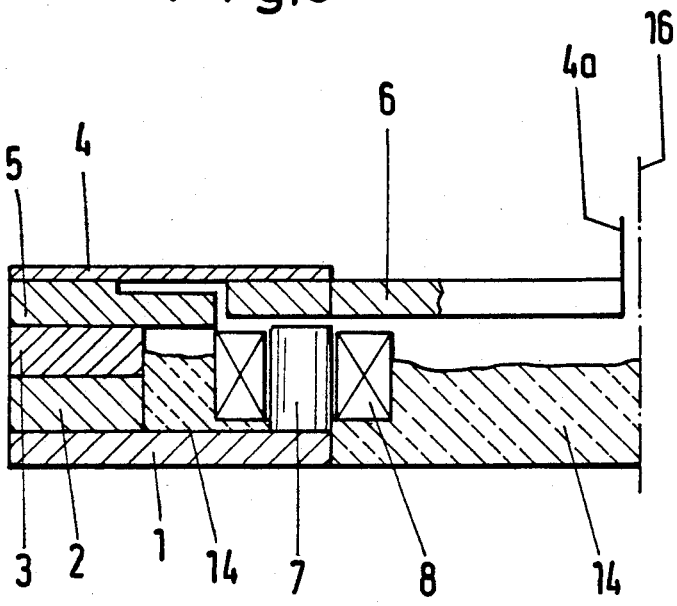
FIG. 5 is a half-side cross-section according to FIG. 1 for a third embodiment.
Figure 6:
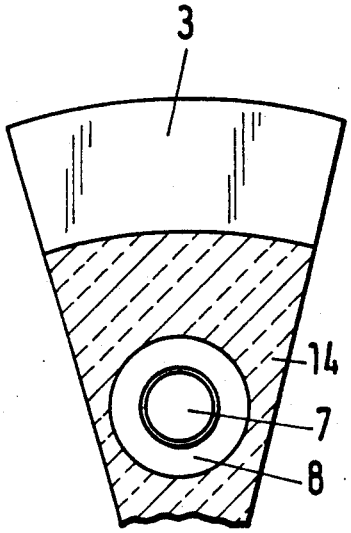
FIG. 6 is a top plan view onto the embodiment of FIG. 5, with armature removed.

A third embodiment, illustrated in FIGS. 5 and 6, shows that a flowable mass 14 made of magnetic non-conductive material is poured or cast around all electromagnetic coils 8. In this case, the mass 14 has incorporated and distributed, for example, soft-iron powder or, respectively, soft ferromagnetic powderized materials.

Figure 7:
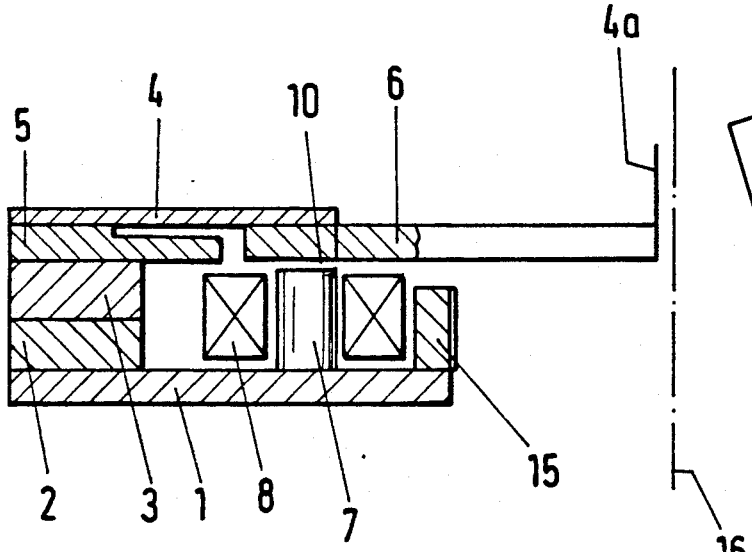
FIG. 7 is a half-side cross-section according to FIG. 1 for a fourth embodiment.
Figure 8:
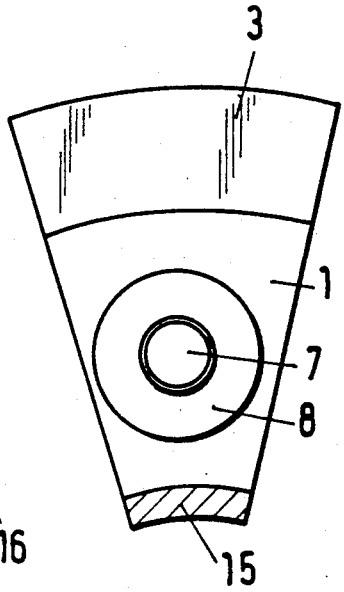
FIG. 8 is a top plan view onto the embodiment of FIG. 7, with armature removed.

Further means for increasing the shielding relative to external magnetic fields, such as electromagnetic fields and permanent magnet fields, can be formed by a core ring or core ring segments 15, which are disposed concentrically relative to the print head center axis 16, as illustrated in FIGS. 7 and 8.

It will be understood that each of the elements described above, or two or more together, may also find a useful application in other types of print heads and magnetic actuating systems differing from the types described above.

While the invention has been illustrated and described as embodied in the context of a matrix pin print head, particularly of the biased construction, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A matrix pin print head comprising a base plate made of a soft-magnetic material;

an annular permanent magnet disposed on the base plate; a distance spacer ring made of a soft-magnetic material; a plurality of actuators, each of said actuators comprises a radially outwardly disposed pretensioned spring;

a soft magnetic material configuration;

an electromagnetic coil disposed on the base plate, wherein each electromagnetic coil is at least partially surrounded at its circumference with said soft-magnetic material configuration and is thereby shielded against a magnetic field of neighboring electromagnetic coils;

an armature body at a radially inwardly disposed point attached at the respective spring, which armature body is biased against the core of the electromagnetic coil disposed in each case on the base plate, wherein the magnet flux, generated by the annular permanent magnet, is to be balanced by feeding current into the electromagnetic coil, and wherein the armature body can be shot off against a recording material carrier;

a print element attached at the armature body.

2. The matrix pin print head according to claim 1, wherein each electromagnetic coil is surrounded fully at its circumference with soft-magnetic materials.

3. The matrix pin print head according to claim 1 wherein each electromagnetic coil is surrounded fully at its circumference with soft-magnetic materials.

4. The matrix pin print head according to claim 1, wherein a side magnet shunt flux circuit is formed by a magnetic short circuit body disposed opposite to an end of the electromagnetic coil and parallel to the main magnet flux circuit formed over the annular permanent magnet.

5. The matrix pin print head according to claim 1, wherein the print head is formed based on the biased construction configuration, wherein the armature body is subject to a bias field.

6. The matrix pin print head according to claim 1, and wherein the soft magnetic material configuration is a separating wall, made of a soft-magnetic material, and is disposed between two electromagnetic coils in each case.

7. The matrix pin print head according to claim 1, wherein the soft magnetic material configuration is a ring made of a soft-magnetic material surrounding at least one of the electromagnetic coils.

8. The matrix pin print head according to claim 1, wherein the soft magnetic configuration is a core ring, which core ring is disposed concentrically relative to the print head center axis, wherein electromagnetic coils, disposed diametrically opposite to each other, are shielded by way of the core ring.

9. The matrix pin print head according to claim 1, wherein the soft magnetic configuration is a core ring, which core ring is disposed in elliptical shape relative to the print head center axis, wherein electromagnetic coils, disposed diametrically opposite to each other, are shielded by way of the core ring.

10. The matrix pin print head according to claim 1, wherein the soft magnetic material configurations are core-ring segments, which core-ring segments are disposed concentrically relative to the print head center axis, wherein electromagnetic coils, disposed diametrically opposite to each other, are shielded by way of core-ring segments.

11. The matrix pin print head according to claim 1, wherein the soft-magnetic material configurations are core-ring segments, which core-ring segments are disposed in elliptical shape relative to the print head center axis, wherein electromagnetic coils, disposed diametrically opposite to each other, are shielded by way of core-ring segments.

12. The matrix print head according to claim 1, wherein the shielding of the electromagnetic coils relative to each other is provided by having each electromagnetic coil be surrounded at its circumference by way of a soft-magnetic material member selected from the group consisting of soft iron, steel with low carbon content, an amorphous ferromagnetic metal allow and mixtures thereof.

13. The matrix print head according to claim 1, wherein separating walls made of soft iron are disposed on two sides of the electromagnetic coil.

14. The matrix print head according to claim 1, wherein the electromagnetic coil is surrounded by a ring made of a soft-magnetic material and furnishing the soft magnetic material configuration.

15. The matrix print head according to claim 1, wherein the soft magnetic material configuration is made of a flowable mass including magnetically non-conductive material cast around all electromagnetic coils and wherein the flowable mass incorporates a soft ferromagnetic powderized material.

16. The matrix print head according to claim 1, wherein the magnetic material configuration is furnished by core ring segments, which core ring segments are disposed concentrically relative to the print head center axis for forming a core ring and for increasing the shielding relative to external magnetic fields, such as electromagnetic fields and permanent magnet fields.

17. The matrix print head according to claim 1, wherein the soft magnetic configuration is furnished by a separating wall made of a soft-magnetic material and wherein the separating wall is disposed between two neighboring electromagnetic coils to eliminate a partial shielding between electromagnetic coils, and wherein at least one of the neighboring electromagnetic is surrounded by a ring made of a soft magnetic material.

18. The matrix print head according to claim 1, wherein the soft magnetic material configuration is provided by a cast of a flowable mass made of a magnetically non-conductive material and incorporating soft-magnetic particles and wherein the cast surrounds all electromagnetic coils, and wherein the soft magnetic material configuration is furnished by a core ring surrounding electromagnetic coils disposed diametrically opposite to each other for shielding the electromagnetic coils relative to each other and wherein the core ring is disposed in a shape from concentric to elliptical relative to the print head center axis.

19. The matrix pin print head according to claim 1 further comprising an attachment plate disposed between the distance ring made of soft magnetic material and the spring.

20. The matrix pin print head according to claim 19, wherein the thickness of the attachment plate is from about 0.5 to 2 times the thickness of the annular permanent magnet and wherein the thickness of the spacer ring is from about 0.5 to 2 times the thickness of the annular permanent magnet.

21. A matrix pin print head, particularly of the biased construction, with a base plate made of a soft-magnetic material, an annular permanent magnet disposed on the base plate, a distance spacer ring made of a soft-magnetic material, a plurality of actuators, each of said actuators comprising a radially outwardly disposed pretensioned spring, where an armature body at a radially inwardly disposed point is attached in each case at the spring, which armature body is biased against the core of an electromagnetic coil disposed on the base plate, wherein the magnet flux, generated by the permanent magnet, can be balanced by feeding current into the electromagnetic coil, and wherein the armature body can be shot off against a recording material carrier, where a print element is attached at the armature body, and wherein a side magnet shunt flux circuit is formed via a short circuit body above the main magnet flux circuit formed over the permanent magnet, wherein each electromagnetic coil (8) is surrounded at its circumference (8*a*) in part or fully with soft-magnetic materials (11) and is thereby shielded against the magnet field of neighboring electromagnetic coils (8).

22. The matrix pin print head according to claim 21, wherein in case of a partial shielding of an electromagnetic coil (8), there is disposed a separating wall (12), made of a soft-magnetic material (11), between two electromagnetic coils (8).

23. The matrix pin print head according to claim 21, wherein at least one of the neighboring electromagnetic coils (8) is surrounded by a ring (13) made of a soft-magnetic material (11).

24. The matrix pin print head according to claim 21, wherein electromagnetic coils (8), disposed diametrically opposite to each other, are shielded by way of core-ring segments (15), which are disposed concentrically or in elliptical shape relative to the print head center axis (16).

25. The matrix pin print head according to claim 21, wherein electromagnetic coils (8), disposed diametrically opposite to each other, are shielded by way of core-ring segments (15).

26. A matrix pin print head comprising a base plate made of a soft-magnetic material;

an annular permanent magnet disposed on the base plate;

a distance spacer ring made of a soft-magnetic material; a plurality of actuators, each of said actuators comprising a radially outwardly disposed point pretensioned spring;

a soft magnetic material configuration;

an electromagnetic coil disposed in each case on the base plate, wherein each electromagnetic coil is surrounded at its circumference with said soft-magnetic material configuration and is thereby shielded against a magnetic field of neighboring electromagnetic coils;

an armature body at a radially inwardly disposed point attached at the respective spring, which armature body is biased against the core of the electromagnetic coil disposed in each case on the base plate, wherein the magnet flux, generated by the annular permanent magnet, is to be balanced by feeding current into the electromagnetic coil, and wherein the armature body can be shot off against a recording material carrier;

a print element attached at the armature body;

wherein the soft magnetic material configuration is formed of a flowable mass made of a magnetically non-conductive material incorporating soft-magnetic particles, which flowable mass is cast around all electromagnetic coils.

27. A matrix pin print head particularly of the biased construction, with a base plate made of a soft-magnetic material, an annular permanent magnet disposed on the base plate, a distance spacer ring made of a soft-magnetic material, a radially outwardly disposed pretensioned spring, a plurality of actuators, each of said actuators comprising a radially outwardly disposed pretensioned spring, where an armature body at a radially inwardly disposed point is attached at the spring, which armature body is biased against the core of an electromagnetic coil disposed on the base plate, wherein the magnet flux, generated by the permanent magnet, can be balanced by feeding current into the electromagnetic coil, and wherein the armature body can be shot off against a recording material carrier, where a print element is attached at the armature body, and wherein possibly a side magnet shunt flux circuit is formed via a short circuit body above the main magnet flux circuit formed over the permanent magnet, wherein each electromagnetic coil (8) is surrounded at its circumference (8*a*) in part or fully with soft-magnetic materials (11) and is thereby shielded against the magnet field of neighboring electromagnetic coils (8), wherein a flowable mass (14) made of a magnetically non-conductive material and incorporating soft-magnetic particles is cast around all electromagnetic coils (8).

28. A method for shielding electromagnetic coils in a matrix pin print head comprising assembling a base plate made of a soft-magnetic material, an annular permanent magnet disposed on the base plate, a distance spacer ring made of a soft-magnetic material, an at a radially outwardly disposed point pretensioned spring and an electromagnetic coil disposed on the base plate;

surrounding each electromagnetic coil at its circumference with a soft-magnetic material configuration, thereby shielding the electromagnetic coil;

generating a magnetic field at a neighboring electromagnetic coil and diverting the magnet field of the neighboring electromagnetic coil away from the electromagnetic coil with the soft magnetic material configuration;

biasing an armature body at a radially inwardly disposed point attached at the respective spring against the core of the electromagnetic coil disposed in each case on the base plate;

feeding current into the electromagnetic coil for balancing a magnet flux, generated by the annular permanent magnet; and shooting off the armature body with a print element attached at the armature body.

* * * * *